US005649699A

United States Patent [19]

Todoroff

[11] Patent Number: 5,649,699

[45] Date of Patent: Jul. 22, 1997

[54] RACQUET SPORTS TRAINING DEVICE

[76] Inventor: David J. Todoroff, 216 Lexington Ave., Buffalo, N.Y. 14222

[21] Appl. No.: 515,368

[22] Filed: Aug. 15, 1995

[51] Int. Cl.[6] ..... A63B 61/00

[52] U.S. Cl. ..... 473/425; 473/429

[58] Field of Search ..... 273/26 E, 29 A, 273/30, 61 C, 58 C

[56] References Cited

U.S. PATENT DOCUMENTS

| | | | |
|---|---|---|---|
| 2,094,536 | 9/1937 | Heimers | 273/29 A |
| 2,128,610 | 8/1938 | Heimers | 273/29 A |
| 2,769,636 | 11/1956 | Finestone | 273/30 |
| 2,945,695 | 7/1960 | Heimers | 273/29 A |
| 3,531,115 | 9/1970 | Alexander | 273/58 C |
| 3,709,490 | 1/1973 | Manfred | 273/26 E |
| 3,896,949 | 7/1975 | Dunker | 273/61 C |
| 4,071,239 | 1/1978 | Ferguson | 273/29 A |
| 4,076,239 | 2/1978 | Hall | 273/29 A |
| 4,095,787 | 6/1978 | Saferstein | 273/26 E |

FOREIGN PATENT DOCUMENTS

| | | | |
|---|---|---|---|
| 697207 | 1/1931 | France | 273/29 A |
| 2604970 | 8/1977 | Germany | 273/29 A |
| 3131705 | 3/1983 | Germany | 273/29 A |

*Primary Examiner*—Theatrice Brown

*Attorney, Agent, or Firm*—Hodgson, Russ, Andrews, Woods & Goodyear, LLP

[57] ABSTRACT

A racquet sports training device which can be used by one person alone, either indoors or outdoors, and which enables the user to hit a ball with the racquet and have the ball returned to him thereby allowing repeated hitting and even while the user is on the run. An elastic cord is connected at one end to a ball of the type for hitting by the racquet during playing of the particular sport, and there is provided a component for releasably connecting the opposite end of the cord to the racquet. A swivel is connected to the cord in a manner preventing tangling of the cord during use of the training device. As a result, the user can practice hitting the ball with the racquet, and after each time the ball is hit in a direction away from the racquet the elastic cord returns the ball in a direction toward the racquet. When the device is used for training in tennis, a pressureless tennis ball is connected to one end of the elastic cord, and the opposite end of the cord is connected to the strings of a tennis racquet by means of a vibration damper. In an alternative version of the tennis training device, the one end of the cord is connected to the strings on the upper end of a net on a tennis court.

11 Claims, 7 Drawing Sheets

RACQUET SPORTS TRAINING DEVICE

BACKGROUND OF THE INVENTION

This invention relates to the art of sporting goods, and more particularly to a new and improved racquet sports training device.

One area of use of the present invention is as a tennis training device although the principles of the present invention can be variously applied to other racquet sports. In the design of a training device for tennis and similar racquet sports, important considerations are that the player can use the training device either indoors or outdoors and that after the ball is hit by the racquet it always returns to the user. In other words there should be no limitations on where the training device can be used, and the device should avoid the need for the user to chase balls and at the same time allow hitting the ball on the run. Other important considerations are the desirability of enabling a person using the training device to practice on his own and to develop hand-eye coordination thereby gaining confidence before practicing or taking lessons in groups. It is believed that a training device which is easy and fun to use, is relatively economic and is convenient to pack and carry will potentially interest more people in the racquet sports games. All of the foregoing considerations which apply to a training device for tennis apply equally as well to devices for other racquet sports such as squash, racquetball, badminton and lacrosse.

One prior art tennis training device features a ball secured at one end of a long cord, the other end of which is anchored to the ground by a weight or other means. The user practices by hitting the ball, but once hit the ball does not always return to the user. Furthermore because of the length of the cord, typically about ten to twenty feet, this device requires a large area for use, it is difficult to keep the ball repetitively in play, and this device does not enable the user to hit the ball on the run.

It would, therefore, be highly desirable to provide a racquet sports training device which can be used anywhere, which during use reliably returns the ball to the user after it is hit by the racquet, and which is highly effective in enabling the user to practice the racquet sport on his own and develop hand-eye coordination.

SUMMARY OF THE INVENTION

The present invention provides a racquet sports training device which can be used by one person alone, either indoors or outdoors, and which enables the user to hit a ball with the racquet and have the ball returned to him thereby allowing repeated hitting and even while the user is on the run. An elastic cord is connected at one end to a ball of the type for hitting by the racquet during playing of the particular sport, and there is provided means for releasably connecting the opposite end of the cord to the racquet. A swivel means is connected to the cord in a manner preventing tangling of the cord during use of the training device. As a result, the user can practice hitting the ball with the racquet, and after each time the ball is hit in a direction away from the racquet the elastic cord returns the ball in a direction toward the racquet. When the device is used for training in tennis, a pressureless tennis ball is connected to one end of the elastic cord, and the opposite end of the cord is connected to the strings of a tennis racquet by means of a vibration damper. In an alternative version of the tennis training device, the one end of the cord is connected to the strings on the upper end of a net on a tennis court.

The foregoing and additional advantages and characterizing features of the present invention will become clearly apparent upon a reading of the ensuing detailed description together with the with the included drawing wherein:

BRIEF DESCRIPTION OF THE DRAWING FIGURES

DETAILED DESCRIPTION OF THE ILLUSTRATED EMBODIMENTS

Figure 1:
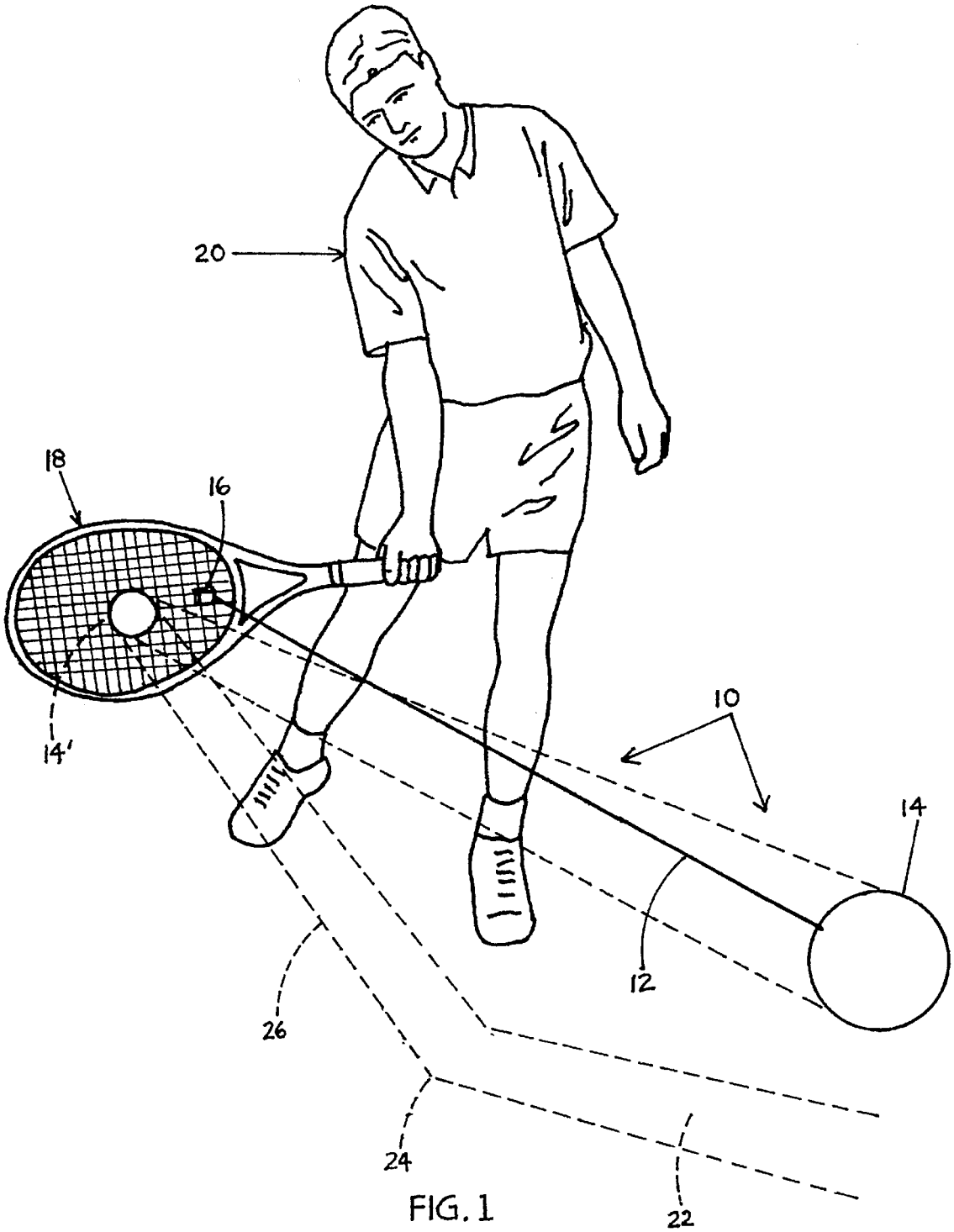
FIG. 1 is a perspective view, partly diagrammatic, showing a tennis training device according to the present invention as it would be used in practicing ground strokes.
Figure 2:
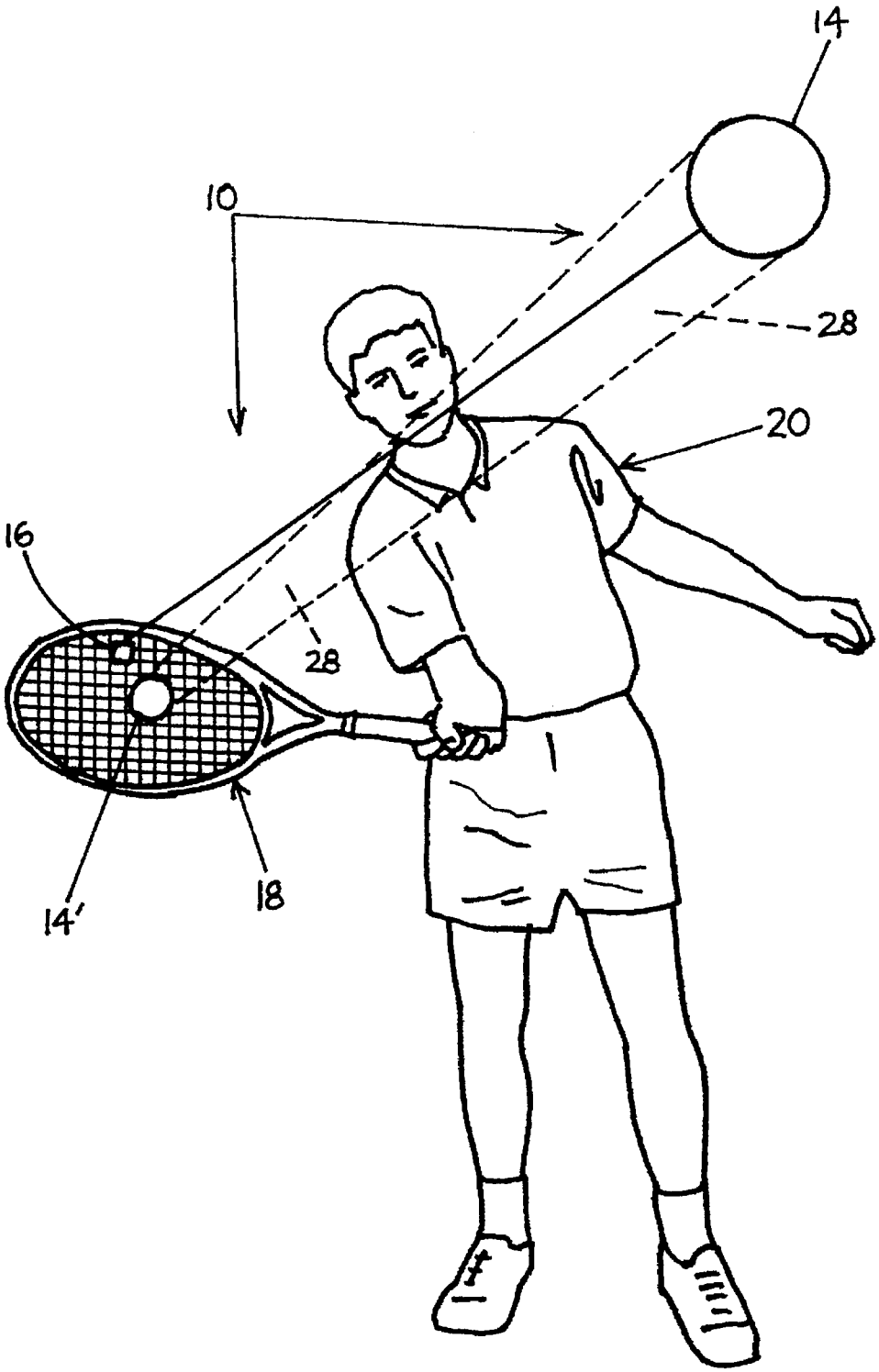
FIG. 2 is a perspective view, partly diagrammatic, showing the tennis training device as it would be used in practicing volleying.

The racquet sports training device of the present invention is shown in FIGS. 1 and 2 as it would appear in use as a tennis training device. Referring first to FIG. 1, the tennis training device 10 includes an elastic cord 12 connected at one end to a tennis ball 14 in a manner which will be described and having means 16 at the other end for releasably connecting cord 12 to a tennis racquet 18. The releasable connecting means 16 will be described in detail presently. The tennis training device 10 according to the present invention enables the user 20 to practice hitting tennis ball 14 with racquet 18, and after each time the ball 14 is hit in a direction away from the racquet 18 the elastic cord 12 returns the ball 14 in a direction toward the racquet 18. This is seen in FIG. 1 which illustrates the user 20 practicing ground strokes wherein the return path of the ball 14 includes a first portion 22 to a point 24 where the ball bounces on the ground and then returns further along the path portion 16 whereupon it is in front of racquet 18 as indicated at 14' and ready to be hit again during the next forehand stroke of the racquet. A swivel means (not shown in FIG. 1) is connected to cord 12 for preventing tangling of cord 12 during use in a manner which will be described.

The tennis training device 10 is shown is FIG. 2 being used to practice forehand volleying. Here the return path of ball 14 includes the single relatively straight portion 28 by which the ball is returned to a location in front of racquet 18 as indicated at 14' and ready to be hit again during the next volley stroke of the racquet.

Some of the advantages of the tennis training device 10 of the present invention are the following. It attaches to any tennis racquet easily and enables the user to practice both indoors and outdoors and in a limited amount of space. The device 10 develops eye/hand coordination, maximizes repetition of stroke and develops the ability to sustain a rally. Regular use of device 10 conditions muscles needed for tennis. By virtue of elastic cord 12 returning ball 14 to racquet 18, one never has to chase balls and device 10 can be used to practice moving and hitting. The tennis training device 10 of the present invention is excellent for all levels of ability and helps the user master the most difficult shots in the game.

Figure 3:
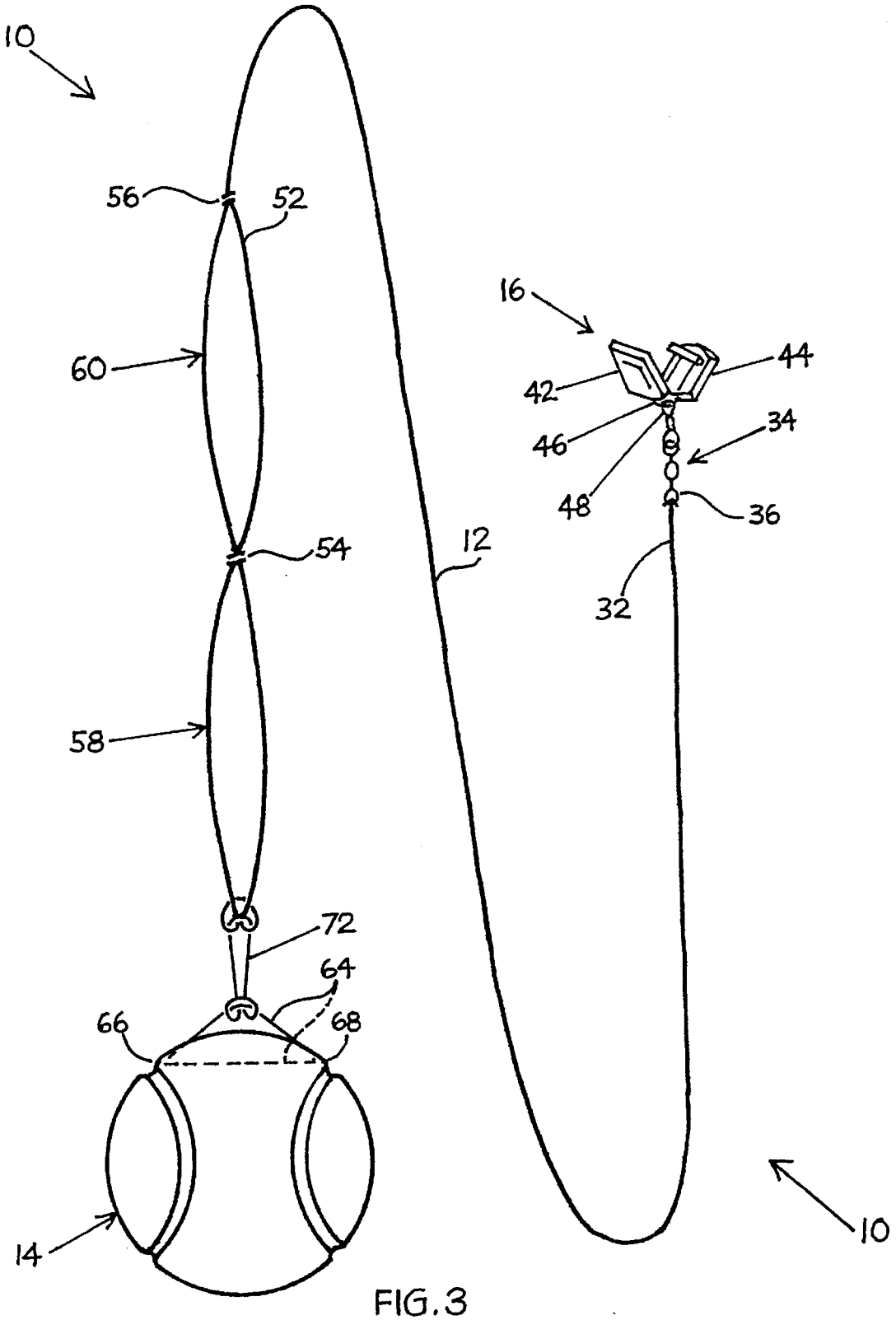
FIG. 3 is a perspective view of the tennis training device according to the present invention.

The tennis training device 10 according to the present invention is shown in further detail in FIG. 3. Elastic cord 12 has an overall length of about 50–55 inches, a diameter of about 1/10 inch and is of the same material used for bungee-jumping cords. By way of example, in an illustrative device 10, elastic cord 12 is commercially available from Rhode Island Textile under the designation Shock Cord. The one end 32 of cord 12 is connected to swivel means generally designated 34 which serves to prevent tangling of cord 12 during use of device 10. By way of example, in an illustrative device 10, swivel means 34 is a standard fishing swivel commercially available from Eagle Claw Co. of Troy, Mich. under the designation #12 interlock swivel. The end 32 of cord 12 is tied to an eyelet 36 at one end of swivel 34.

Swivel means 34 is connected to the means 16 for releasable connection to tennis racquet 18. In accordance with the present invention, releasable connection means 16 comprises a vibration absorber or damper which enables cord 12 to be connected to the strings of tennis racquet 18. The vibration absorber is of flexible material such as plastic having two parts 42 and 44 joined by a hinge 46. The eyelet 48 on the opposite end of swivel 34 is wired or otherwise connected to hinge 46. The manner in which connecting means 16 is connected to the tennis racquet strings will be described in detail presently. By way of example, in an illustrative device 10, the releasable connection means 16 is a clip-on vibration absorber commercially available from Dunlop under the designation Vibrazorb.

The other end 52 of cord 12 is utilized to form two knots 54 and 56 defining two loops 58 and 60 as shown in FIG. 3. One reason for the two loops 58 and 60 is to facilitate shortening the overall length of cord 12 for certain tennis drills in a manner which will be described presently. Another reason for the single loop 58 defining the end of cord 12 is to facilitate connection to tennis ball 14 in the following manner.

In the tennis training device 10 of the present illustration, ball 14 is a commercially available pressureless tennis ball. An elastic band 64 is inserted through the wall of tennis ball 14 using a needle of proper size to "thread" band 64 through two puncture openings 66 and 68 in ball 14. The two free ends of band 64 are pulled tight and knotted so that band 64 is in firm contact with the surface of ball 14. The knot can be urged into one of the puncture openings to conceal the same. By way of example, in an illustrative device 10, band 64 is a stretch elastic band commercially available from Rhode Island Textile under the designation SS114. Alternatively, ball 14 can be a commercially available foam ball for the purpose of indoor use and also for use by children. It would be attached to cord 12 essentially the same way.

Figure 4A:
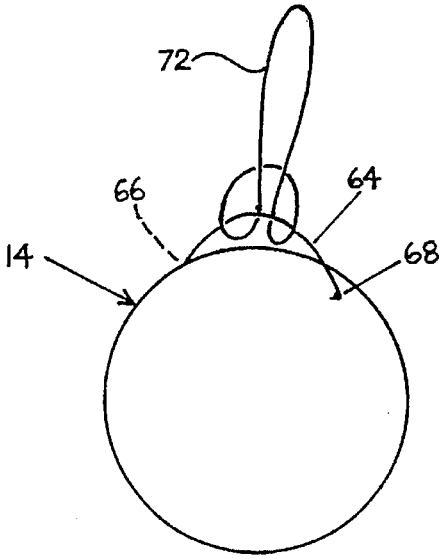
FIGS. 4A and 4B are diagrammatic views, partly in perspective, showing the manner in which the elastic cord is connected to the tennis ball in the device of FIG. 3.
Figure 4B:
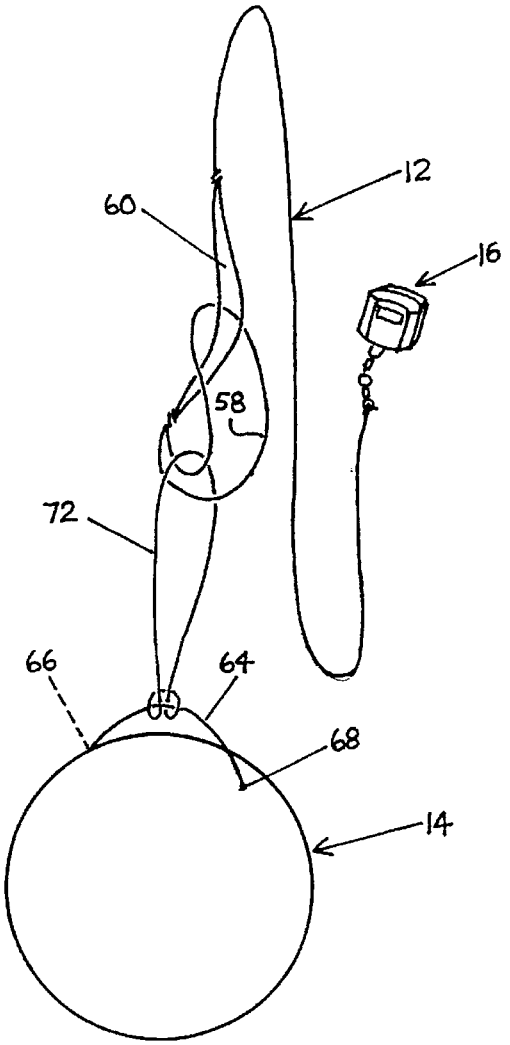

Cord 12 is connected to tennis ball 14 in the following manner. A conventional medium rubber band 72 is looped between elastic band 64 and the outer surface of ball 14. One end of rubber band 72 is inserted through the open loop at the other end of band 72 whereupon the rubber band 72 is pulled taut and thereby anchored to elastic band 64. This is illustrated in further detail in FIG. 4A. Next, the end loop 58 of cord 12 is inserted through the open loop of rubber band 72 and the vibration absorber 16 at the other end of cord 12 is inserted through the loop 58 in cord 12. This is illustrated in further detail in FIG. 4B. Then cord 12 is pulled taut thereby completing the assembly shown in FIG. 3. The provision of rubber band 72 maximizes the useful life of device 10 especially when ball 14 is bounced on abrasive surfaces. In addition, rubber band 72 is convenient and easy to replace.

Figure 5:
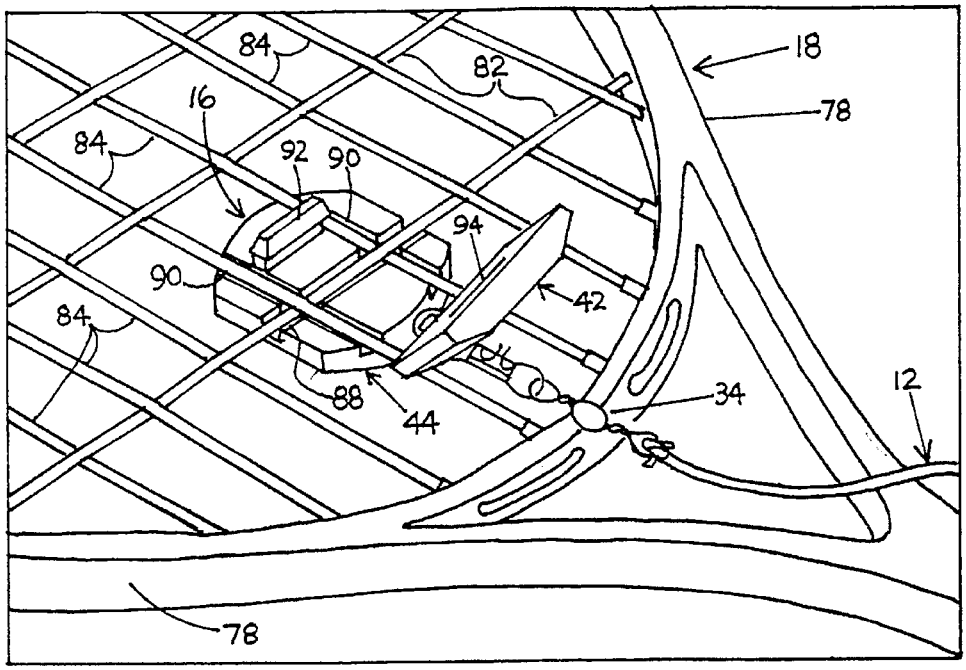
FIG. 5 is a perspective view of the means for connecting the end of the elastic cord to the strings of a tennis racquet in the device according to the present invention and showing the connecting means in an open position where it can be removed from the strings.
Figure 6:
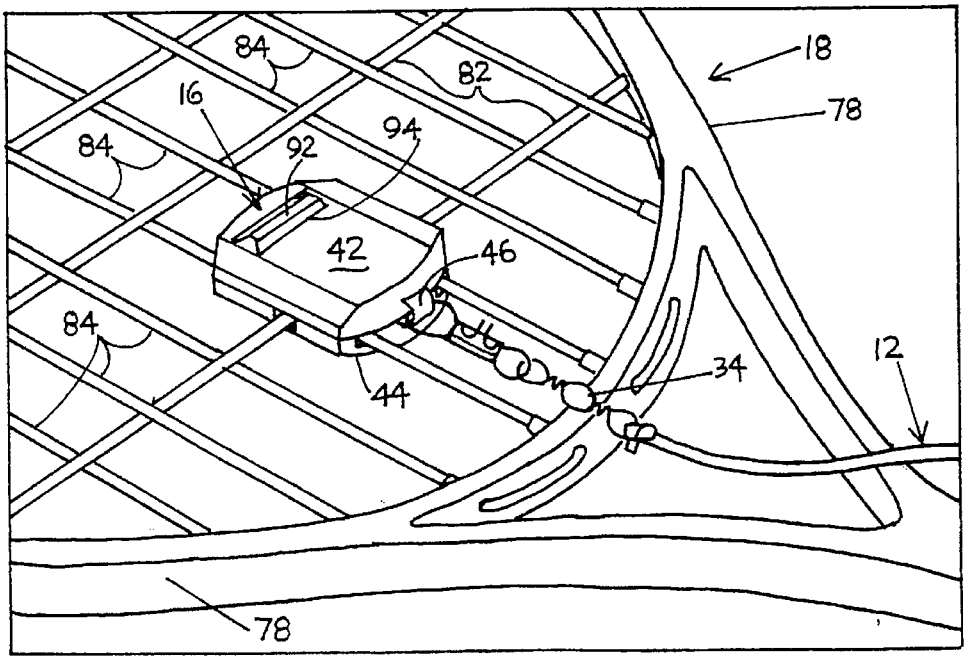
FIG. 6 is a view similar to FIG. 6 but showing the connecting means in a closed position where it is secured to the strings of the racquet.

FIGS. 5 and 6 illustrate in further detail the releasable connecting means 16 and the manner in which it is connected to tennis racquet 18 which includes a frame 78, handle 80 and an arrangement of strings including 82 running cross-wise of frame 78 and strings 84 running perpendicular to strings 82 and thus lengthwise of racquet 18 relative to handle 80. The connecting means or vibration dampener 16 is provided with string receiving grooves or recesses 88 and 90 in part 44 for the cross-wise strings 82 and lengthwise strings 84, respectively. A tab 92 extends from part 44 and snap-fits in a slot 94 provided in part 42. For most practice drills using device 10 with the exception of volley drills, the connecting means 16 is connected to the strings of racquet 18 near the throat end of the racquet which is near the portion of frame 78 which joins handle 80. As shown in FIG. 4, part 44 is positioned so that groove 88 receives the racquet cross string 82 closest the throat end of the racquet and so that grooves 90 receive the two adjacent lengthwise strings 84 which run closest to the center of the racquet face. Then, the connection means 16 is closed on the strings by moving parts 42 and 44 together so that tab 92 snap-fits in slot 94. This is done in a manner so that swivel 34 is unobstructed and cord 12 can extend freely out from the strings of the racquet.

With the tennis training device 10 as shown in FIG. 3 attached at one end to racquet 18 in the manner shown and described in connection with FIGS. 4 and 5, the device 10 is ready for use. A person using tennis training device 10 typically will begin by holding racquet 18 out in front of him, dropping ball 14 onto the floor or ground and then taps or hits ball 14 in a forward direction. Cord 12 returns ball 14 toward racquet 18 for the next stroke in the manner described in connection with FIG. 1. At the beginning level, the user 20 can drop the ball 14 and actually open the face of the racquet 18 and tap the ball up so it is actually like hitting the ball up in the air. The ball 14 will travel until it reaches the end of the shock cord 12 which will stretch, and then with a little bit of a mild slingshot effect return ball 14 back in the direction from whence it came. So, at the beginning level, the user 20 can actually hit the ball back up in the air, hit up and down, hit ball 14 up and let it bounce and when it bounces get the racquet 18 underneath ball 14 and repeat this.

As the user 20 gets better with device 10, instead of hitting the ball 14 up in the air and more straight up and letting it bounce, what the user 20 can do is hit the ball 14, close or turn the face of the racquet 18, start with the racquet out in front of him, bounce the ball and tap the ball forward to about a height of about 3 to 5 feet, up in the air aiming out in front and the ball again will travel to the end of the shock cord 12 which stretches and then returns ball 14 back. If the user 20 puts the racquet 18 back in the proper point of contact which is slightly out in front of him, he is ready to then tap the ball forward with a little bit of a forward body movement which is really the gist of the tennis stroke—the racquet out in front with a slight push through the ball—and the user 20 can keep this ball 14 going repeatedly. If the user 20 takes the racquet 18 back too far, i.e. if he draws the racquet back behind himself, the combination of the racquet cord 12 stretching and the user 20 then pulling the racquet 18 back causes the cord 12 to have an even greater slingshot action and the ball will come back much faster to the point to where the user 20 cannot keep the ball going. Thus, device 10 actually has a built-in correcting feature for this aspect of the tennis stoke.

The device 10 of the present invention is particularly effective in isolating contact which is probably the most important part of the stroke. Also, the repetition after awhile teaches the user to relax at the point of impact. The more one does it, the better one becomes. Working with the device 10, one begins to relax the arm a little bit more on impact and that is one of the great features of the device 10. One thing most people have a tendency to do in tennis is to muscle the ball. If one can relax at the point of impact between ball and racquet, one can swing with great racquet speed and that is what device 10 teaches; even though the user 20 can't bring the racquet 18 back very far, it the user 20 learns to relax at impact it is a crucial part of learning tennis.

Thus, device 10 isolates the contact point which is so crucial in the game of tennis. Probably one of the worst "bad habits" that the average tennis player has is drawing the racquet back too far and not yet acquiring the timing in the field for the proper point of contact in which to be able to hit the ball in a consistent fashion. The device 10 allows the user 20 to work from point of contact to a slight follow through. He is passing through the ball, making contact, with a slight mini backswing, but very slight, and racquet 18 comes forward to point of contact where it actually hits the ball 14 and then it passes through the ball so the user 20 actually develops this very little mini-stroke which is the essence of the sport. From there, anything can be built upon once that is mastered. There is actually a lot of room for creativity and style using device 10 including how far to draw the racquet 18 back, what grip to use, etc. Point of contact with slight follow through and having the feel for that and not being tense, not being forced, not being abrupt and just being confident and taking the racquet 18 through, gently easing the racquet through the ball 14 and not trying to combat or fight the tennis ball are key functions all of which can be developed using device 10 of the present invention.

The tennis training device 10 of the present invention can be used by a wide variety of persons, by tennis players at all levels of ability and in any location indoors or outdoors where at least about six feet of playing space is available. Both children and adults can use device 10 with similar effectiveness. Since device 10 eliminates the need to chase balls, it is well-suited for use by handicapped persons. The benefits provided to beginning players have already been described. Intermediate players can use device 10 in practicing volleying, developing spins and enhancing eye concentration on the ball. Advanced players can practice stroke isolation, approach shots and half-volleys. Through repeated use of device 10, advanced players can develop the "feel" of the ball. Device 10 is easily carried and packed so that persons can take it while travelling for business or pleasure to use away from home.

There are a wide variety of tennis shots, spins and skills that can be learned using device 10 of the present invention. They include forehand and backhand strokes, the various types of grips one uses in holding the racquet, volleys and half-volleys, topspin and underspin, cross court and down the line ball placement, touch shots such as lobs and drop shots, alternating forehands and backhands, continuous volleys, footwork, keeping the racquet in front of the body and learning racquet preparation quickly and smoothly. Also, the connection of the end of cord 12 to the strings of racquet 18 brings ball 14 repeatedly back in the direction of the "sweet spot" of racquet 18 thereby enabling the user 20 to experience the difference between the "sweet spot" and the remainder of racquet 18. Furthermore, the device 10 enables one to isolate easily any weakness in tennis techniques and work on it in a controlled, constructive manner. In addition, device 10 can be used by tennis players to warm up before playing a match.

Figure 7A:
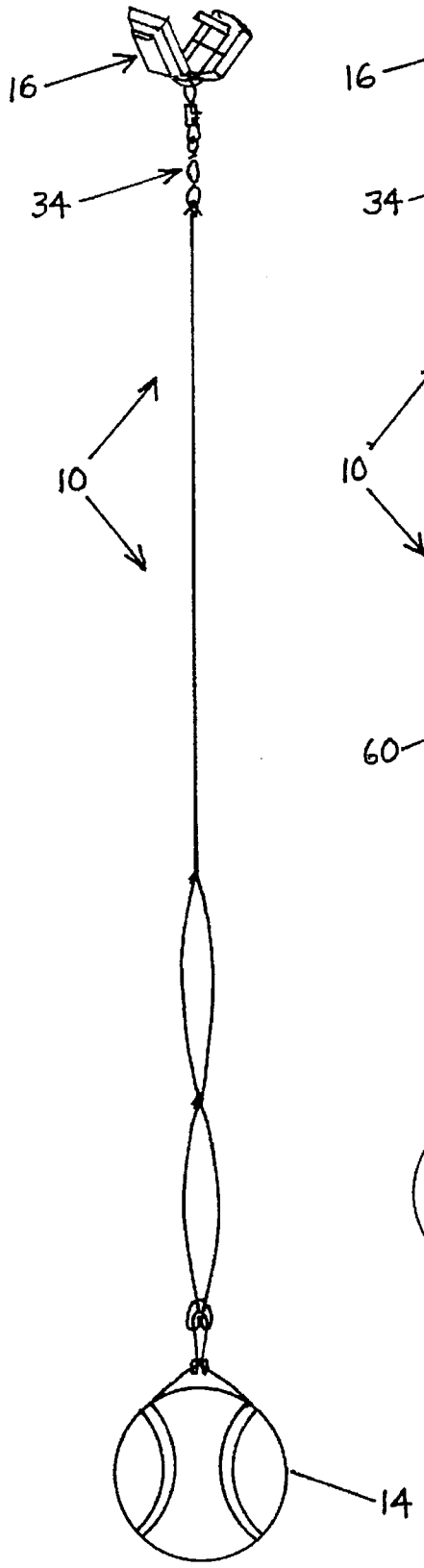
FIGS. 7A, 7B and 7C are perspective views of the tennis training device according to the present invention and showing the manner in which the effective length of the elastic cord can be adjusted.
Figure 7B:
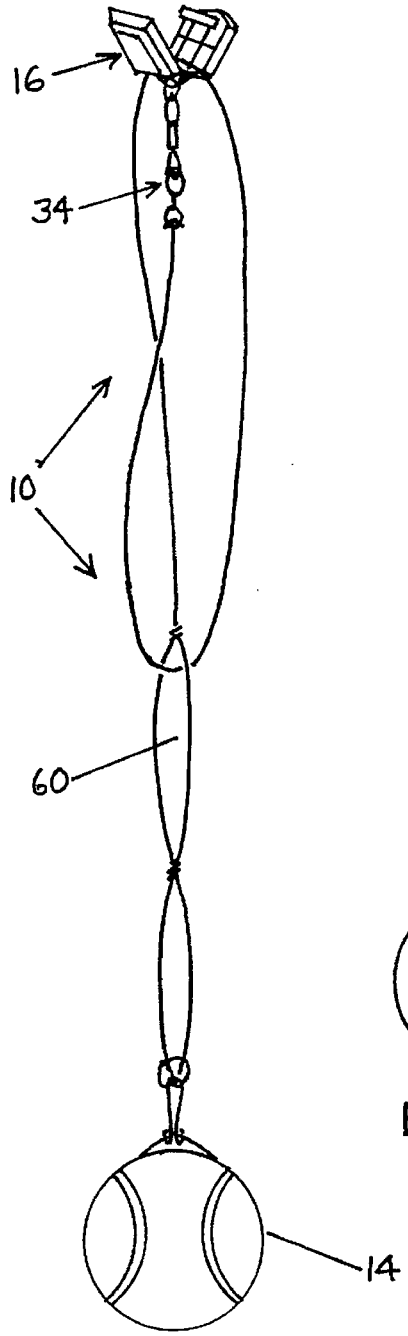
Figure 7C:
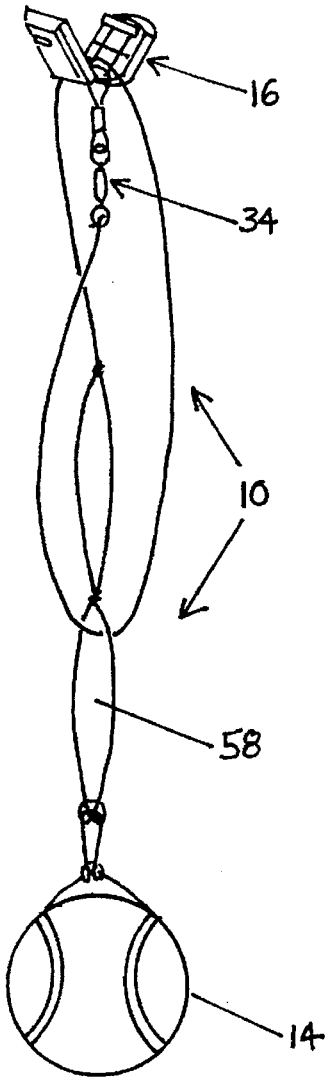

When device 10 is used in practicing volleying as shown and described in connection with FIG. 2, it is desirable to shorten the length of cord 12 and connect vibration damper 16 at a different location on the strings of racquet 18. Damper 16 is easily disconnectable from the racquet strings, and the loops 58 and 60 facilitate shortening the length of cord 12. The parts 42 and 44 of damper 16 are simply pryed to the open position shown in FIG. 4 thereby allowing removal of cord 12 so that it can be held at the full length position shown in FIG. 7A. Damper 16 then is grasped by hand, passed through the loop 60 and then the larger loop thus formed in cord 12 is caught in the opened parts 42 and 44 of damper 16 as shown in FIG. 7B. This shortens the overall length of cord 12 when the larger loop in the cord is pulled taut. If an even shorter length is desired the foregoing procedure is followed using instead the loop 58 as illustrated in FIG. 7C. With cord 12 shortened to the desired length, damper 16 is re-connected to the strings of racquet 18 at a location mid-way along the side of frame 78 as shown in FIG. 2. Device 10 then is well-suited for practicing volleying.

The length of cord 12 and its connection to racquet 18 enables the user 20 to sustain a rally in hitting the ball 14 which is the really fun and enjoyable part of playing tennis. It has also been found that the length of cord 12 and its connection to racquet 18 commands the attention of children using device 10. In other words, since ball 14 is consistently and relatively quickly returned toward racquet 18 after being hit thereby, one using device 10 must focus attention and concentration on the ball 14 and use of device 10 and there is no time delay enabling one's mind to wander or attention to be directed from the practicing. All of the foregoing is enhanced when cord 12 is made even shorter in length according to the procedures illustrated in FIGS. 7B and 7C.

Figure 8:
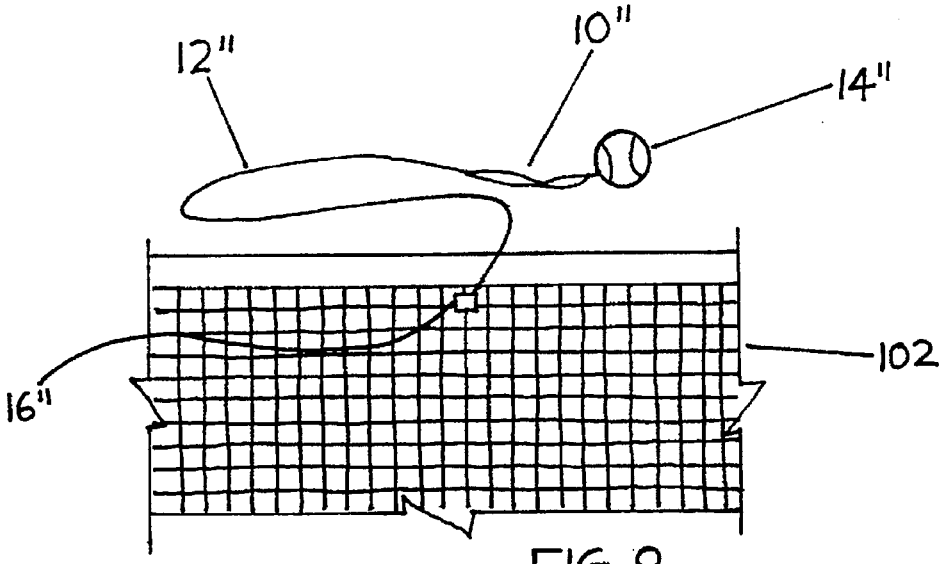
FIG. 8 is a fragmentary elevational view showing an alternative manner of use of the tennis training device of the present invention.
Figure 9:
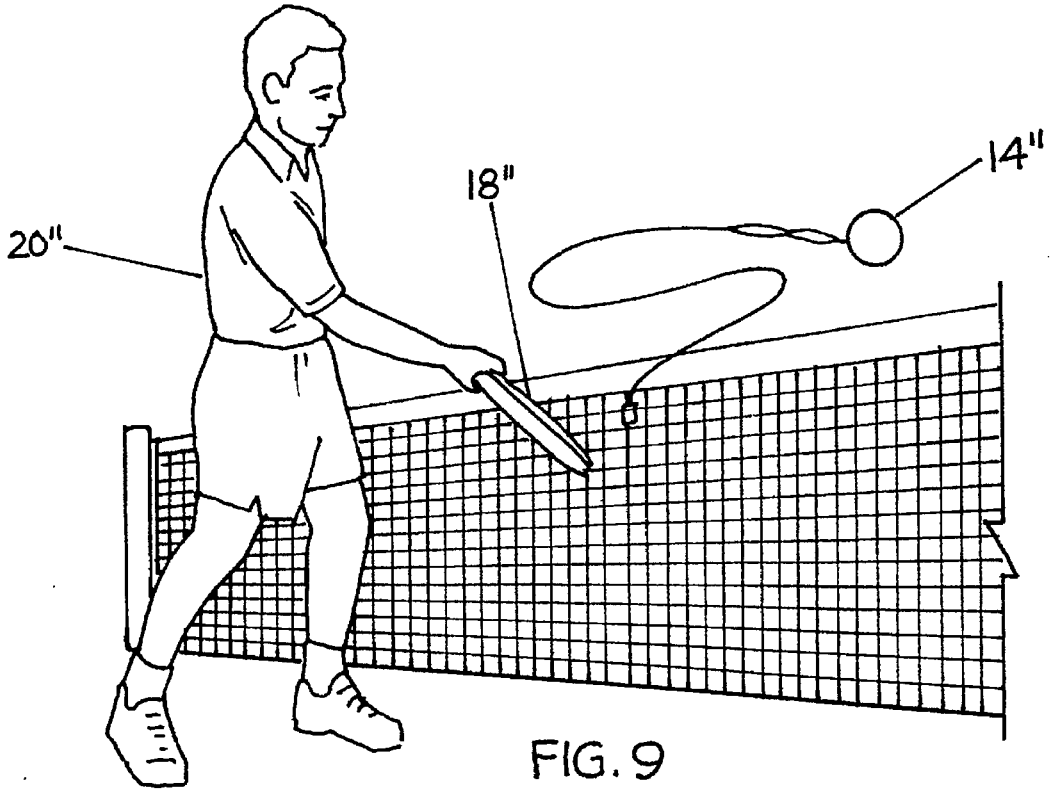
FIG. 9 is a perspective view further illustrating use of the device of FIG. 8.

FIGS. 8 and 9 illustrate an alternative manner of using the tennis training device of the present invention. The connecting means or vibration damper 16", instead of being connected to the strings of racquet, is connected to a standard net 102 on a tennis court. In particular, the parts 42 and 44 of damper 16 are opened and the grooves 88 and 90 are aligned with the strings of net 102 as close to the top of net 102 as possible. Then parts 42 and 44 are closed to secure the cord 12" to net 102 as shown in FIG. 8. A user 20" of this form of device 10" stands close to net 102 and hits ball 14" up and over net 102. Ball 14" will bounce on the other side of net 102 and return toward racquet 18". The device 10" even can be used with two players on opposite sides of net 102 to practice volleying and the like.

The principles of the present invention are readily adaptable to other racquet sports such as squash, racquetball, lacrosse and badminton. The cord would be attached at one end to the squash ball, racquetball, lacrosse ball or bird in the case of badminton. The other end of the cord would be releasably connected to the racquet for the particular sport involved, and a swivel would be provided to prevent tangling of the cord.

It is therefore apparent that the present invention accomplished its intended objects. Device 10 is easy to use, beneficial for all levels of play, can be used indoors as well as outdoors in a limited amount of space, fits on any strung racquet and can be attached and taken off quickly and easily. It is extremely durable and made of quality materials. The device 10 allows a player to practice by himself or can be used with another player. It improves reflexes and conditions muscles, especially those of the hand, wrist, arm and shoulder for the racquet sport being practiced. The device 10 improves consistency in a short period of time, and develops a sense of rhythm to the stroke which is crucial to all racquet sports. It improves eye-hand coordination and improves a player's sense of concentration as they quickly learn to keep the ball in play longer.

The tennis training device 10 allows repetitive practice of the point contact of the stroke. This aspect of the practice device is one of its greatest strengths. It also features self-correcting of proper place in which point of contact should occur. If the ball is not struck in the correct place, the device makes it very difficult and uncomfortable to keep the ball going. A player using device 10 makes actual repetitive contact with the ball more often than almost any other form of practice (about one contact per half-second). By constantly striking the ball over and over, the player develops a distinct sense of feel for the ball which is also crucial for rapid improvement. Because the practice device 10 is attached to the racquet 18, it is possible for the player of at least intermediate skill to hit the ball on the run repeatedly (simulating an approach shot, for example) which is very difficult to isolate and almost impossible to work on alone. The player can practice stroking the ball with non-dominant hand which is extremely beneficial in working the two-handed backhand helping to make that weaker side stronger and more coordinated. The beginning player can practice and develop the eye-hand coordination needed to rally the ball consistently in private. Therefore, the beginner's confidence level is heightened, making it easier to move through this difficult phase of the game of tennis.

While embodiments of the present invention have been described in detail, that is for the purpose of illustration, not limitation.

What is claimed is:

1. A racquet sports training device for practicing with a racquet used in a particular racquet sport, said device comprising:

(a) a ball for hitting by the racquet during playing of the particular racquet sport;

(b) an elastic cord connected at one end to the ball;

(c) means for releasably connecting the opposite end of said cord to the racquet and comprising a body having a pair of parts hinged together and provided with recesses to receive strings of the racquet and including means to releasably connect said parts together and against the strings;

(d) swivel means connected to said cord for preventing tangling of said cord during use of said device; and (e) so that a user can practice hitting said ball with the racquet and after each time said ball is hit in a direction away from the racquet said elastic cord returns said ball in a direction toward the racquet.

2. A tennis training device for practicing with a tennis racquet comprising:

(a) a pressureless tennis ball;

(b) an elastic cord;

(c) means for connecting one end of said elastic cord to said tennis ball;

(d) means for releasably connecting the other end of said elastic cord to the tennis racquet and comprising a body having a pair of parts hinged together and provided with recesses to receive strings of the tennis racquet and including means to releasably connect said parts together and against the strings; and (e) swivel means connected to said cord for preventing tangling of said cord during use of said device;

(f) so that a user can practice hitting said tennis ball with the racquet and after each time said ball is hit in a direction away from the racquet said elastic cord returns said ball in a direction toward the racquet.

3. A tennis training device according to claim 2, wherein said body is connected near the throat end of the racquet.

4. A tennis training device according to claim 2, wherein said swivel means is connected between said other end of said elastic cord and said body.

5. A tennis training device for practicing with a tennis racquet comprising:

(a) a pressureless tennis ball;

(b) an elastic cord;

(c) means for connecting one end of said elastic cord to said tennis ball;

(d) means for releasably connecting the other end of said elastic cord to strings of a net on a tennis court and comprising a body having a pair of parts hinged together and provided with recesses to receive strings of the net and including means to releasably connect the parts together and against the strings; and (e) swivel means connected to said cord for preventing tangling of said cord during use of said device;

(f) so that the user can practice hitting said tennis ball with the racquet and after each time said ball is hit in a direction away from the user and over the net said elastic cord returns said ball in a direction toward the user.

6. A tennis training device according to claim 5, wherein said means for releasably connecting said elastic cord to said net comprises a body having a pair of parts hinged together and provided with recesses to receive strings of the net and including means to releasably connect said parts together and against the strings.

7. A tennis training device for practicing with a tennis racquet comprising:

(a) a pressureless tennis ball;

(b) an elastic cord;

(c) means for connecting one end of said elastic cord to said tennis ball and comprising an elastic band extending into and secured to said tennis ball and a rubber band joining said elastic band to said one end of said elastic cord;

(d) means for releasably connecting the other end of said elastic cord to the tennis racquet; and (e) swivel means connected to said cord for preventing tangling of said cord during use of said device; (f) so that a user can practice hitting said tennis ball with the racquet and after each time said ball is hit in a direction away from the racquet said elastic cord returns said ball in a direction toward the racquet.

8. A tennis training device for practicing with a tennis racquet comprising:

(a) a pressureless tennis ball;

(b) an elastic cord;

(c) means for connecting one end of said elastic cord to said tennis ball;

(d) means for releasably connecting the other end of said elastic cord to the tennis racquet;

(e) swivel means connected to said cord for preventing tangling of said cord during use of said device;

(f) so that a user can practice hitting said tennis ball with the racquet and after each time said ball is hit in a direction away from the racquet said elastic cord returns said ball in a direction toward the racquet; and (g) at least one loop formed in said one end of said cord for shortening the overall length of said cord by passing said other end of said cord through said loop to define another loop and engaging said another loop by said connecting means whereupon when said cord is drawn taut the overall length is shortened.

9. A tennis training device according to claim 8, including two adjacent loops formed in said one end of said cord to provide two different shortened overall lengths of said cord.

10. A tennis training device according to claim 9, wherein said connecting means comprises a body having a pair of parts hinged together and provided with receses to receive strings of the racquet and including means to releasably connect said parts together and against the strings, said another loop being defined by said cord extending between said parts of said connecting means.

11. A tennis training device according to claim 8, wherein said connecting means comprises a body having a pair of parts hinged together and provided with recesses to receive strings of the racquet and including means to releasably connect said parts together and against the strings, said another loop being defined by said cord extending between said parts of said connecting means.

* * * * *